United States Patent [19]

Tateishi

[11] 4,406,416

[45] Sep. 27, 1983

[54] JAW CRUSHER

[76] Inventor: Isao Tateishi, 9-2 Funabashi 1-chome, Setagaya-ku, Tokyo, Japan

[21] Appl. No.: 328,381

[22] Filed: Dec. 7, 1981

Related U.S. Application Data

[63] Continuation of Ser. No. 116,996, Jan. 30, 1980, abandoned.

[51] Int. Cl.[3] ..... B02C 1/04

[52] U.S. Cl. ..... 241/269; 241/264

[58] Field of Search ..... 241/264–269

[56] References Cited

U.S. PATENT DOCUMENTS

| | | | |
|---|---|---|---|
| 2,828,925 | 4/1958 | Rumpel | 241/267 |
| 2,865,570 | 12/1958 | Nutting | 241/266 X |
| 2,931,585 | 4/1960 | Butler | 241/269 X |
| 3,166,259 | 1/1965 | Archer et al. | 241/267 X |
| 3,861,604 | 1/1975 | Nobelius | 241/269 |

FOREIGN PATENT DOCUMENTS

| | | | |
|---|---|---|---|
| 52-268 | 4/1977 | Japan | 241/264 |

*Primary Examiner*—Howard N. Goldberg
*Attorney, Agent, or Firm*—Pennie & Edmonds

[57] ABSTRACT

A jaw crusher for crushing stones or rocks of large mass in which a movable jaw is driven, on the fulcrum of a swingable supporting rod which supports the lower portion of said movable jaw, by means of swingable arms of a lever pivoted to the upper portion of the movable jaw through a lever mechanism which is moved by hydraulic cylinders. The stationary jaw is separated into two sections, so that the upper stationary jaw may be fixed at optional positions by virtue of means for freely advancing or withdrawing said jaw in horizontal directions.

4 Claims, 2 Drawing Figures

JAW CRUSHER

This is a continuation of application Ser. No. 116,996, filed Jan. 30, 1980, now abandoned.

BACKGROUND OF THE INVENTION

Conventionally known is a jaw crusher in which a substantially vertical stationary jaw is mounted between machine frames, a movable jaw is arranged opposite from the lower portion of the stationary jaw diagonally upwards, the upper end of said movable jaw is supported by an eccentric axis thereby to give a swivel movement to the upper end portion and a vertical swinging movement to the lower end portion, when stones and rocks of larger mass are charged from the upper portion of an opening between said two jaws, and the stones and rocks are crushed under pressure to smaller pieces by means of the motion of said movable jaw, while the crushed stones and rocks are discharged from a discharge port in the lower portion of the opening.

According to the known crusher, the movable jaw is moved under pressure against the stationary jaw by the swivel motion of its upper end portion and the arc motion of its lower end portion whereby the stones or rocks between the jaws are crushed under pressure, the stones or rocks which have become gradually or smaller mass are dropped downwards in order, and the stones or rocks smaller in size than the discharge port in the lower portion are discharged from said port.

With said conventional jaw crusher there is a fear of accident such as being caught by the belt since the eccentric wheel including its fly-wheel is driven through V-belts by motor. Further, there was a great danger of causing injury to humans because it is impossible to quickly stop the operation by vitrue of inertia of the fly-wheel for example, when it is tried to remove foreign articles entered into the crushing chamber.

Furthermore, a motor of great horse power is required to crush stones or rocks of the size greater than a certain extent, and therefore the machine becomes large-sized while increasing its own weight. Moreover, the conventional jaw crusher could not adjust its crushing ability and caused very great noise and vibration.

In addition, the movable jaw driven by an eccentric axis carries out crushing by means of a horizontal movement of an acute triangle on the fulcrum of one end of a supporting rod so that the body to be crushed is crushed in directions whereby it is likely they will become acute-angled bodies.

Thus, there has existed for some time a strong need for a way to remove these various disadvantages and provide a jaw crusher having a high crushing efficiency.

SUMMARY OF THE INVENTION

The present invention relates to a jaw crusher for crushing stones, rocks or concrete masses, and more particularly to a jaw crusher in which a movable jaw is driven by means of a hydraulically operated layer mechanism.

It is a major object of the present invention to provide a jaw crusher in which a movable jaw is driven by a swingable arm of a lever pivoted to the upper portion of the jaw through a lever mechanism moved by hydraulic cylinders. The jaw moves about the fulcrum of a swingable supporting rod which supports the lower portion of said movable jaw.

Another object of the invention is to provide a jaw crusher wherein the opening portion at a discharge port in the lower portion of said stationary jaw is provided with a grid which is capable of advancing or withdrawing to follow the movement of said movable jaw.

Further object of the invention is to provide a jaw crusher wherein a supporting rod which supports the lower portion of the movable jaw and a supporting block of a first tension rod are supported on a inclined surface of an adjustable guide frame which can be vertically moved by a jack along the vertical face of the machine frame, said supporting block is horizontally moved by the vertical movement of said guide frame, and a second tension rod always draws said supporting block.

Still another object of the invention is to provide a jaw crusher wherein the stationary jaw having a crushing surface of vertical direction are separated into two upper and lower portions, and the upper stationary jaw can be fixed at an optional position by virtue of means for freely advancing or withdrawing said jaw in horizontal directions.

BRIEF DESCRIPTION OF THE DRAWINGS

The present invention may be better understood by reference to the accompanying drawings, in which.

DESCRIPTION OF THE PREFERRED EMBODIMENT

Figure 1:
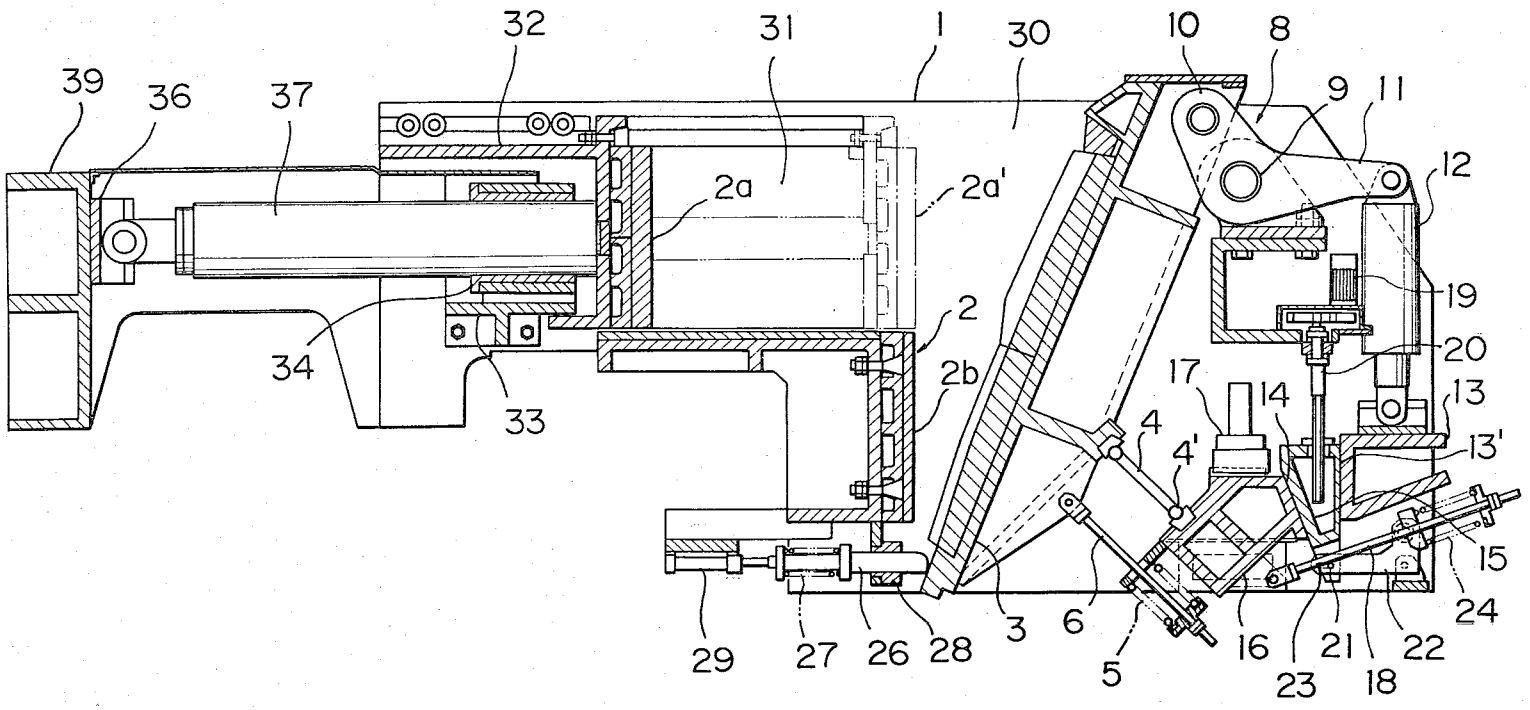
FIG. 1 is a vertical, sectional front view of a jaw crusher according to the invention.
Figure 2:
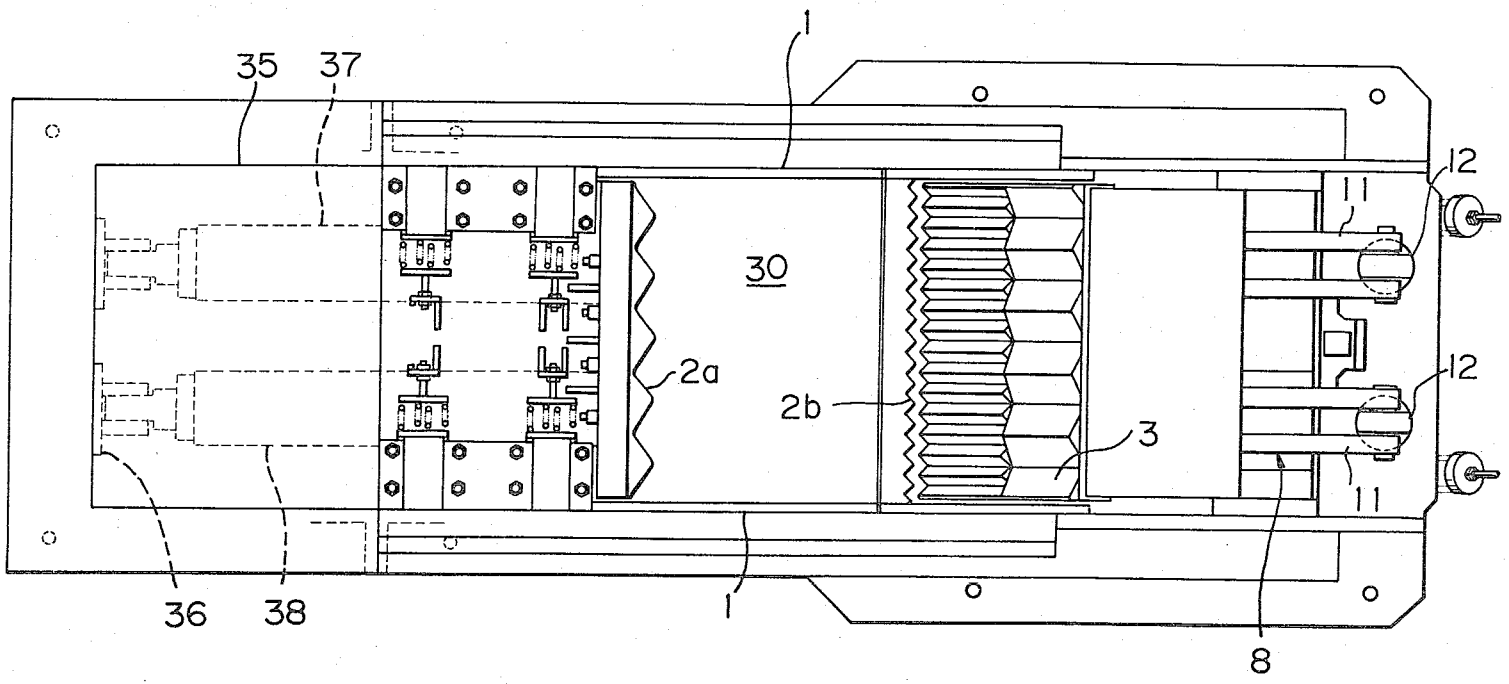
FIG. 2 is a plan view of the jaw crusher of FIG. 1.

Referring to the FIGS. 1 and 2, between machine frames 1, 1 is arranged a substantially vertical stationary jaw 2, and a movable jaw 3 is oppositely arranged from the lower portion of said stationary jaw diagonally upwards. The movable jaw 3 is constructed in such a way that it is supported at its lower portion to the machine frame 1 by a supporting rod 4, and its lower end portion is pulled always to the end portion (the right side direction in FIG. 1) of the machine frame 1 by a first tension rod 6 urged by means of a coil spring 5, while the upper end portion of the movable jaw is connected to one arm 10 of a lever 8 which is moved on a pivotably axis 9 mounted on the frame 1 and the other arm 11 is connected to a hydraulic cylinder 12. As shown in FIG. 2, the lever 8 and the hydraulic cylinder 12 are arranged in two series and drive the movable jaw 3 synchronously. In the jaw crusher constructed according to the present invention, said movable jaw 3 carries out a downward arc motion for crushing stones and rocks while pressing them down by means of the swinging motion of said lever 8, so that the articles to be crushed are not only split under compression but also crushed to be twisted under compression between the stationary jaw 2 and the movable jaw 3. On the other hand, since a crushing chamber 30 is in a wedge form the articles to be crushed cannot escape upwards and are pressed out downwardly thereby producing a great crushing ability. Further, the arm 10 of the lever 8 is driven to trace circular arcs on the fulcrum of the swingable axis 9 when the movable jaw 3 makes a composite motion to the horizontal and downward directions, so that the articles to be crushed are crushed while jostling with one another. Accordingly, there are manufactured good crushed stones or rocks with a slight roundness.

Further, by changing the ratio of the lengths between the swingable arms 10 and 11 of said lever it is possible to make the crushing power $\frac{1}{2}$–$\frac{1}{3}$ due to the utilization of the lever principle to increase the power. Furthermore, compared with the mechanism in which movable jaw is directly driven by hydraulic cylinder there is no hydraulic cushion provided, and the movable jaw is driven by a lever on the fulcrum of a pivotable axis whereby a great crushing ability is provided. If non-crushable articles such as iron pieces enter into the crushing chamber the operation can be stopped by adjusting the relief valves (not shown) of the hydraulic cylinders. Otherwise it is possible to take out by hand the iron pieces and the like of the crushing chamber by operating the hydraulic apparatus minutely. Moreover, it is possible to change variously the strokes of the arc motion of said movable jaw by varying the strokes of said cylinders through the adjustment of a limit switch (not shown).

The position of a supporting point 4' of said supporting rod 4 may be varied as described below. That is, there is shown a wedge-like adjustable guide frame 15 in which one face thereof can vertically move along a vertical surface 13' of a stationary block 13 mounted to the machine frame 1, and the other opposite face consists of an inclined surface 14. A supporting block 16 for a fulcrum 4' of said supporting rod 4 is located along said inclined surface 14. The supporting block 16 supports said supporting rod 4 and fixes the movable jaw at a drawn state by the first tension rod 6 through a coil spring 5. The lower surface of a part 17 of the machine frame slidably supports the block in such a manner that the upper surface of said supporting block 16 is movable in horizontal directions, the right side thereof is engaged with said inclined surface 14, and the lower end is pressed, as described hereinafter, against said vertical surface 13' through the adjustable guide frame 15 by a second tension rod 18 urged by means of a coil spring.

The adjustable guide frame 15 is capable of moving vertically along the vertical surface 13' by means of a jack 20 driven by a motor 19, and a pin 21 provided near the lower end of said frame 15 is slidably fitted to an oval slot 23 of a long arm of a right-angled swingable frame 22 which is pivotally mounted to said machine frame 1.

The pin 21 engaged with the oval slot 23 is lifted following the rising of said adjustable guide frame 15 by the jack 20, when the longer arm of the swingable frame 22 is thus turned upwards. A shorter arm of the swingable frame 22 is passed through and supported by the second tension rod 18 through a coil spring 24, and the other end of said second tension rod 18 is anchored to the lower end of the supporting block 16. Accordingly, as described above, the relative angle with the second tension rod 18 changes according to the displacement of the swingable frame 22 thereby to displace the supporting block 16 to the right in FIG. 1 and then the supporting point 4' of said supporting rod 4 also to the right, while the inclined angle of said movable jaw 3 changes to widen the space of the discharge port of said jaw crusher.

If the jack 20 is reversely driven to lower the adjustable guide frame 15, the supporting block 16 and the supporting point 4' are displaced to the left in FIG. 1, and therefore the movable jaw 3 is displaced to the direction of the stationary jaw 2 when the discharge port of the crusher becomes narrow.

Thus, the adjustable guide frame 15 is vertically moved by driving the jack so that it is possible to adjust the space of the discharge port easily by optionally changing the inclined angle of said movable jaw 3. Further, despite the fact that the position of the movable jaw is variable the tension mechanism at the lower end of the movable jaw is always operable.

In order that the crushing ability be increased it is permissible to widen the space of the discharge port to provide a great displacing stroke of the movable jaw, but a grid 26 is arranged at the lowr end of said stationary jaw 2 so as to prevent non-crushed stones or rocks and flat articles or reinforcing bars from downfall. The grid 26 is constructed in such a manner that it is always urged to the movable jaw by a compression coil spring 27, and it slides in a guide 28 to make it follow the movement of said movable jaw. In the case of removing reinforcing bars or the like blocked near the opening portion it is easily capable of removing them if a hydraulic cylinder 29 is operated to withdraw the grid 26.

Explanation will now be made with regard to an adjustable mechanism of the opening portion of the present jaw crusher. Between the machine frames 1, 1 are oppositely arranged the stationary jaw 2 and the movable jaw 3, and a crushing chamber 30 of an approximately triangle is formed between these jaws.

The materials to be crushed are charged from the upper portion of said crushing chamber 30, but if they are greater in size than the charging port crushing effect is not produced, so that it is necessary previously to split the materials to a desired size by means of pneumatic drill means or explosives before they are charged into the jaw crusher. This causes the generation of noise and necessitates much labor.

According to the invention, said stationary jaw 2 is separated to an upper portion **2*a* and lower portion 2*b*, and the upper stationary jaw 2*a* is surrounded by an upper guide frame 32, a lower guide frame 33, a lining 34 above the frame 33, and a side frame 35 (see FIG. 2) whereby it horizontally slides therein. Said upper portion 2*a* is secured to the end of the plungers which reciprocate within a pair of hydraulic cylinders 37, 38 fixed to one end 36 of the machine frame, to carry out a reciprocal movement by the operation of said hydraulic cylinders. In the embodiment shown, there are shown with solid line a state wherein the upper stationary jaw 2*a* is withdrawn and the opening portion of the jaw crusher is adjusted wide, and with imaginary line a formal state wherein both the upper and lower stationary jaws 2*a'* and 2*b* are on one straight line. Consequently, as shown in FIGS. 1 and 2, if the hydraulic cylinders are operated to withdraw the upper stationary jaw 2*a* to the solid line position, the upper portion of said crushing chamber 30 is widened as shown at 31, while allowing charging of stones and rocks considerably greater than conventionally crushed ones and crushing of bigger stones and rocks by means of the movement of said movable jaw 3. Also it is capable of fixing the withdrawing position of said upper stationary jaw 2*a* to an optional position in the midway between 2*a* and 2*a'*** by means of the operation of the hydraulic cylinders.

Again it is possible to carry out the forward and backwards movements of said upper stationary jaw **2*a*** by driving screw member by means of a reversible motor instead of by the hydraulic cylinders.

Accordingly, by the provision of means for advancing and withdrawing a part of the stationary jaw in a conventional jaw crusher, it is possible even with a smaller-sized crusher to crush stones or rocks of large mass, and the present crusher is very useful to efficiently carry out a crushing working with labor saving and less noise.

What is claimed is:

1. A jaw crusher having arranged between two machine frames a substantially vertical stationary jaw, a movable jaw oppositely and obliquely arranged to said stationary jaw and a crushing chamber defined by said stationary jaw, said movable jaw and said machine frames, into which chamber stones or rocks of large mass are charged wherein they are crushed under pressure to smaller pieces by means of the motion of said movable jaw and are then discharged through a discharge port of the crushing chamber, characterized in that said movable jaw is at its lower portion pivotably supporting by a swingable supporting rod and at its upper portion driven by a lever mechanism pivotable about a pivot means on one of the machine frames, said lever mechanism including first and second arms which move about said pivot means in fixed relationship to one another with the first arm being pivotably connected to the upper portion of the movable jaw and the other second arm being pivotably connected to a reciprocating power means, the discharge port of the crushing chamber being provided with a grid and means for advancing and withdrawing it to follow the movement of lower portion of said movable jaw, whereby the reciprocation of the hydraulic power means causes the lever mechanism to impart reciprocating motion to the movable jaw as defined by arcuate movement of both the supporting rod and the first arm of the lever mechanism.

2. A jaw crusher having arranged between two machine frames a substantially vertical stationary jaw, a movable jaw oppositely and obliquely arranged to said stationary jaw and a crushing chamber defined by said stationary jaw, said movable jaw and said machine frames, into which chamber stones or rocks of large mass are charged wherein they are crushed under pressure to smaller pieces by means of the motion of said movable jaw and are then discharged through a discharge port of the crushing chamber, characterized in that said movable jaw is at its lower portion pivotably supported by a swingable supporting rod and its upper portion driven by a lever mechanism pivotable about a pivot means on one of the machine frames, said lever mechanism including first and second arms which move about said pivot means in fixed relationship to one another with the first arm being pivotably connected to the upper portion of the movable jaw and the other second arm being pivotably connected to a reciprocating power means, and in that the crusher comprises a supporting block adjacent the lower portion of the movable jaw, the block having a rod pivot means which pivotably supports said supporting rod and being guided on one of the machine frames, an adjustable guide wedge means having an inclined surface engaged with said supporting block, said wedge means being moved vertically by a jack means along a vertical face of the frame, first tension rod means connected between the lower portion of the movable jaw and the supporting block to urge the movable jaw toward the block, and second tension rod means connected to the wedge means between the block and the machine frame to urge said block against said wedge means thereby causing the block to move horizontally when the wedge means is moved vertically, whereby the reciprocation of the hydraulic power means causes the lever mechanism to impart reciprocating motion to the movable jaw as defined by arcuate movement of both the supporting rod and the first arm of the lever mechanism.

3. A jaw crusher having arranged between two machine frames a substantially vertical stationary jaw, a movable jaw oppositely and obliquely arranged to said stationary jaw and a crushing chamber defined by said stationary jaw, said movable jaw and said machine frames, into which chamber stones or rocks of large mass are charged wherein they are crushed under pressure to smaller pieces by means of the motion of said movable jaw and are then discharged through a discharge port of the crushing chamber, characterized in that said movable jaw is at its lower portion pivotably supported by a swingable supporting rod and its upper portion driven by a lever mechanism pivotable about a pivot means on one of the machine frames, said lever mechanism including first and second arms which move about said pivot means in fixed relationship to one another with the first arm being pivotably connected to the upper portion of the movable jaw and the other second arm being pivotably connected to a reciprocating power means, the stationary jaw including upper and lower portions, the upper stationary jaw portion being movable to fixed positions in horizontal directions to increase or decrease the size of the crushing chamber, whereby the reciprocation of the hydraulic power means causes the lever mechanism to impart reciprocating motion to the movable jaw as defined by arcuate movement of both the supporting rod and the first arm of the lever mechanism.

4. A jaw crusher according to claim 3 having hydraulic means for moving said upper portion of the stationary jaw in horizontal directions.

* * * * *